US006079646A

United States Patent [19]

Keyssner et al.

[11] Patent Number: 6,079,646

[45] Date of Patent: Jun. 27, 2000

[54] BLADE RING FOR AIR-SWEPT ROLLER MILLS

[75] Inventors: Michael Keyssner, Duesseldorf; Thomas Letsch, Duisburg, both of Germany

[73] Assignee: Loesche GmbH, Duesseldorf, Germany

[21] Appl. No.: 09/236,086

[22] Filed: Jan. 25, 1999

[30] Foreign Application Priority Data

Sep. 25, 1998 [DE] Germany ..... 198 44 112

[51] Int. Cl.[7] ..... B02C 15/00; B02C 23/24

[52] U.S. Cl. ..... 241/47; 241/107; 241/119

[58] Field of Search ..... 241/47, 79.1, 107, 241/119

[56] References Cited

U.S. PATENT DOCUMENTS 4,721,258 1/1988 Dougan et al. ..... 241/57
5,263,855 11/1993 Watson et al. ..... 241/119
5,340,041 8/1994 Henning et al. ..... 241/119
5,605,292 2/1997 Bunton ..... 241/79.1
5,819,947 10/1998 Nardi et al. ..... 241/119 X

FOREIGN PATENT DOCUMENTS

3418196 A1 11/1985 Germany .

*Primary Examiner*—John M. Husar
*Attorney, Agent, or Firm*—Evenson, McKeown, Edwards & Lenahan, P.L.L.C.

[57] ABSTRACT

To reduce the manufacturing costs of air-swept roller mills and comparable mills, according to the invention a segmented polygonal blade ring is provided, which is manufactured from a plurality of polygon segments, which have planar surfaces and are preferably cut to size from metal sheets. To individual polygon segments can in each case be fixed with a predeterminable inclination one or more guide blades. Preferably an outer polygon segment an an inner polygon segment with at least one guide blade form a polygon segment. Polygon segments can be linked to polygon runs and the latter to polygon blade rings with different diameters.

19 Claims, 2 Drawing Sheets

BLADE RING FOR AIR-SWEPT ROLLER MILLS

BACKGROUND OF THE INVENTION

The invention relates to a blade ring for air-swept roller mills having an outer ring and an inner ring, between which are positioned guide blades, accompanied by the formation of flow ducts.

Air-swept roller mills, bowl mills or also vertical air flow mills have grinding rolls rotatable about a fixed axis and which are placed on a rotary grinding bowl. Between the grinding bowl and the mill casing is formed an annular space, in which are positioned substantially radially oriented guide blades for guiding an upward carrier gas flow, e.g. an air flow, with which the ground material is supplied to a classifier. The annular space is constructed as an annulus and with the guide blades located therein is referred to as a blade ring and sometimes as a nozzle ring.

Known blade rings comprise a rolled, cylindrical or conical outer ring and inner ring or a combination of a conical outer or inner ring and a cylindrical inner or outer ring, between which are positioned the guide blades. The guide blades form flow ducts, which generally have a rectangular cross-section.

Apart from these blade rings comprising rolled rings and welded in guide blades, cast blade rings are also known.

Relatively high manufacturing costs are involved in the case of the known blade rings. Particularly with large roller mills, which can have blade rings with an external diameter up to 7 m, manufacture is extremely costly. The one-piece, annular blade rings are also difficult to transport and install and are consequently supplied in segmented form or as annular sectors to the building sites and are assembled there. However, segmentation presupposes an annealing treatment, so that the ring structure is stress-relieved and the separating cuts for producing the segments give rise to no deformation, particularly cracking.

SUMMARY OF THE INVENTION

The object of the invention is to provide a blade ring for air-swept roller mills and comparable mills, which can be easily and inexpensively manufactured, transported and installed and which is suitable for air-swept roller mills of different sizes, more particularly very large air-swept roller mills.

A fundamental idea of the invention is to provide a polygonally constructed blade ring and to manufacture from a plurality of polygon segments a polygon blade ring in segment form. The polygon segments can be assembled in situ to provide the polygon blade ring or can be linked group-wise in prefabricated manner to form polygon runs, which can then be assembled as a closed polygon, i.e. the polygonal blade ring.

According to the invention, at least the outer ring of the blade ring, which can also be referred to as an outer jacket ring, is constructed as a polygon and has a plurality of outer polygon segments, which in plan view represent the connecting paths or chords between the points of the polygon located on an imaginary circle.

Appropriately a polygon blade ring comprises a plurality of outer polygon segments, which with particular advantage can be manufactured from flat metal sheets. The planar polygon segments can be fixed directly or indirectly to the mill casing either vertically or with an angle of inclination, so as to form with the guide blades and an inner ring flow ducts having a constant cross-section or with an upwardly tapering or widening cross-section.

Appropriately on each outer polygon segment is provided at least one guide blade, which can be fixed, e.g. welded, or also detachable. It is advantageous to dimension the polygon segments and guide blades in such a way that two or more guide blades can be positioned on a polygon segment. The guide blades can have an identical or differing construction.

In addition, the guide blades of the polygon segments fixed with a predeterminable inclination can be arranged in a direction coinciding with or opposite to the grinding bowl rotation direction.

In the case of an inner ring constructed in complimentary manner to the outer ring as a polygon and having inner polygon segments with planar, perpendicular or inclined surfaces, it is advantageous that at least one guide blade links the inner and outer segments. The resulting polygon segment is then joined to further polygon segments to provide a polygonal blade ring.

An important advantage of the polygonal construction of the blade ring is the possibility of setting the blade ring at virtually any desired angle. The planar surfaces of an outer polygon segment and the associated inner polygon segment permit this arrangement, whereas in the case of the prior art blade rings the curved surfaces of the inner and outer rings limit the inclination of the guide blades.

The connection of the polygon segments can be detachable or permanent, e.g. by welding. It is advantageous that as a result of the number of polygon segments the divergence from the annular mill casing can be kept relatively small.

Another advantage is that with a larger number of polygon segments, the total number of guide blades of the polygon blade ring can be increased, because the planar surfaces of the outer and inner polygon segments permit the arrangement thereof. A higher number of guide blades makes it possible to optimize the fluid flow and improve the grinding and classifying process.

In the case of several guide blades in one polygon segment, it is possible to differently construct the guide blades and vary them with respect to their shaping, dimensioning and inclination. The guide blades can e.g. be planar or curved, fixed centrally or eccentrically and differently dimensioned.

According to a preferred embodiment the blade ring only has a polygonal outer ring, but no inner ring connected thereto. The guide blades are arranged in "hanging" manner and are only fixed to the outer polygon segments. An inner flow surface, i.e. an inner ring, is formed by an outer surface of the grinding bowl, which is generally cylindrical.

Appropriately the guide blades are constructed in such a way that an inner edge is arranged substantially parallel and at a limited distance from the outer surface of the grinding bowl.

The advantages of the inventively constructed blade ring are the extremely inexpensive manufacture, simplified transportation and also installation, which can be performed without heavy equipment and with a low accident risk. The manufacture of the planar polygon segments of the outer and inner rings is inexpensive, because there is no longer a need for a bending of rolled plates and there is less blanking waste due to the straight edges. Manufacture can be made extremely rational, because several metal sheets can be superimposed and can be cut or burned to the desired shape with a common separating cut. It is possible to prefabricate the polygon segments with one or more guide blades.

Further advantages arise for the grinding and classifying process due to the possible variation of the number, arrangement, construction and inclination of the guide blades on a polygon segment.

BRIEF DESCRIPTION OF THE DRAWINGS

The invention is described in greater detail hereinafter relative to the attached, highly diagrammatic drawings, wherein show.

DETAILED DESCRIPTION RELATIVE TO THE DRAWINGS

Figure 1:
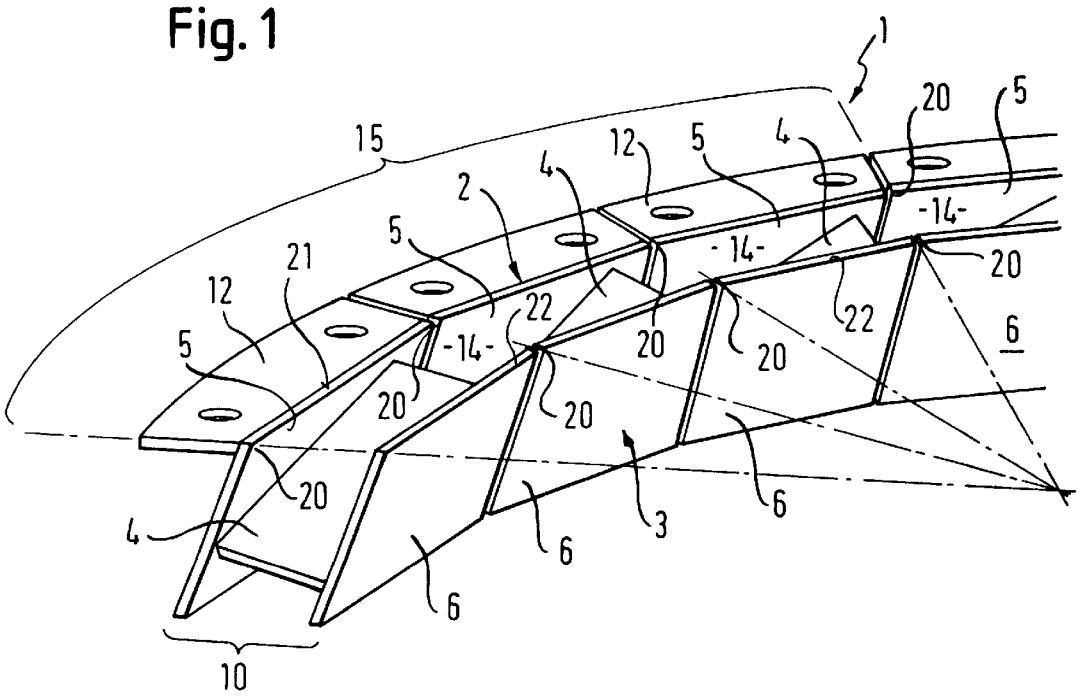
FIG. 1 A detail of a first variant of a segmented polygon blade ring according to the invention in perspective view.

FIG. 1 shows in exemplified manner a first variant of a segmented, polygonal blade ring 1 in a detailed, perspective view. The polygonal blade ring 1 has an outer ring 2, an inner ring 3 and guide blades 4 arranged radially between them. The outer ring 2 and inner ring 3 are constructed in segmented manner and form in plan view a polygon with a plurality of corners or angles 20, which are located on an imaginary circle and whose individual sides are formed by upper edges 21 of outer polygon segments 5 or upper edges 22 of inner polygon segments 6. Thus, the outer polygon segments 5 form chords of an outer jacket ring, the outer ring 2, whereas the inner polygon segments 6 form chords of an inner jacket ring, the inner ring 3.

The dot-dash lines show the sectors of the segmented polygon blade ring 1, whose polygon segments 10 in this variant comprise an outer polygon segment 5, a complimentary inner polygon segment 6 and a guide blade 4.

The guide blades 4 are positioned with a setting angle $\alpha$ (cf. FIG. 2) and form in pairs with the associated areas of the inner ring 6 and outer ring 5 in each case a flow duct 14.

In the present variant, in each case one guide blade 4 links an outer polygon segment 5 with the inner polygon segment 6 to the polygon segment 10, which can be connected with further polygon segments 10 to the segmented polygon blade ring 1.

Figure 2:
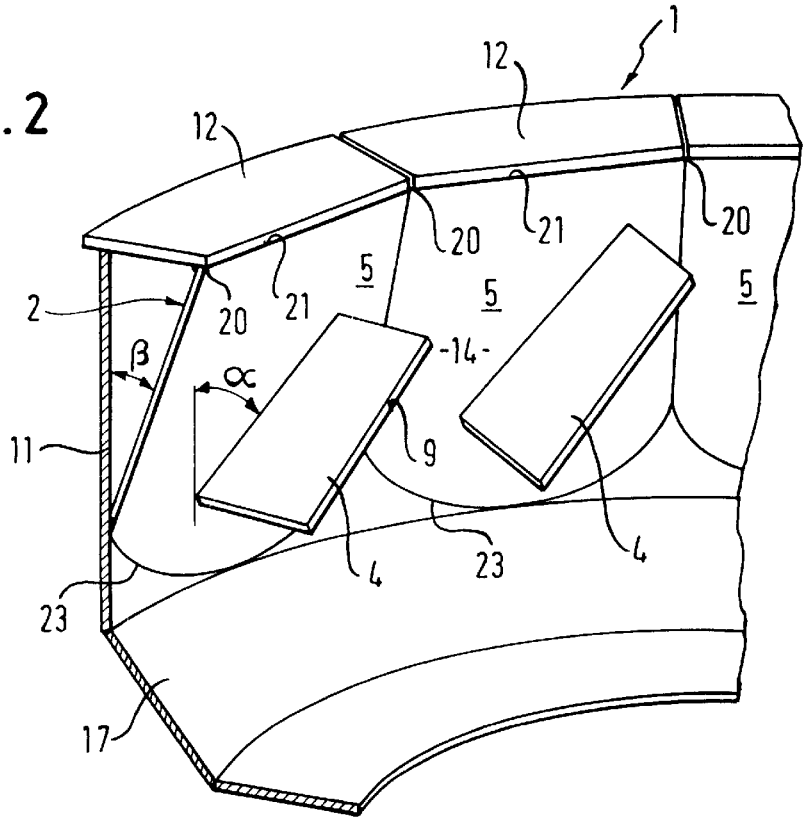
FIG. 2 A detail of a second variant of a segmented polygon blade ring according to the invention in perspective view.

The outer polygon segments 5 and inner polygon segments 6 comprise planar metal sheets, the outer polygon segments 5 being fixed with an angle of inclination $\beta$ to the mill casing 11 (cf. FIG. 2). At the upper end, the outer polygon segments 5, being made of cut-to-size metal sheets, are fixed by means of elements 12, which can also serve as a cover, to the mill casing 11 (cf. FIG. 2).

FIG. 1 also shows a first variant of a polygon run 15 comprising in this case three identically constructed outer polygon segments 5 and inner polygon segments 6 with interposed guide blades 4, i.e. three identically constructed polygon segments 10.

FIG. 2 shows in detail form a second variant of a segmented polygonal blade ring 1. The latter comprises a polygonally constructed outer ring 2 with a plurality of outer polygon segments 5, which are formed from planar metal sheets, and which are fixed to the mill casing 11 by an upper edge 21, via elements 12 and by a lower edge 23 with an angle of inclination $\beta$. The perspective view of the polygonal blade ring 1, without an inner ring and without showing the grinding bowl, makes it possible to easily see an air duct 17 below the polygonal blade ring 1. FIG. 2 makes it clear that the planar surface of the outer polygon segments 5 permits the arrangement of several guide blades 4 on one polygon segment 5 and with different angles of inclination. $\alpha$, as well as clockwise or counterclockwise.

Figure 3:
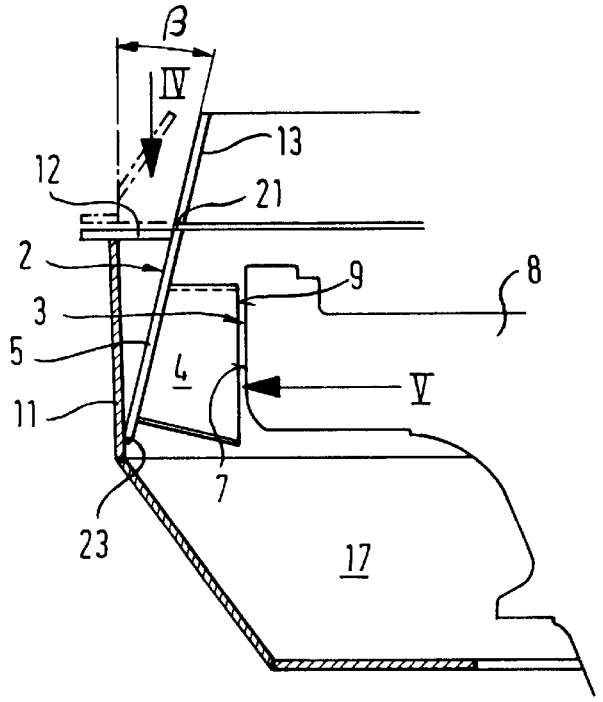
FIG. 3. A longitudinal section through an air-swept roller mill in the vicinity of an inventive, segmented polygon blade ring of the second variant.

FIG. 3 shows the guide blades 4 according to FIG. 2 fixed in "suspended" manner to the outer polygon segments 5 of the polygonal outer ring 2 in a detail sectional representation. The same means are given the same reference numerals as in FIGS. 1 and 2. The guide blades 4 are constructed in such a way that an inner edge 9 runs parallel to an outer surface 7 of the grinding bowl 8. In this variant, the outer surface 7 of the grinding bowl 8 fulfils the function of an inner ring 3 and is constructed cylindrically. Above the outer polygon segments 5 or the polygonal outer ring 2, FIG. 3 shows guide faces 13, which are arranged in the extension of the inclined outer segments 5 and guide a fluid flow from the air duct 17 away from the mill casing 11 and in the direction of the not shown, mill centre.

Figure 4:
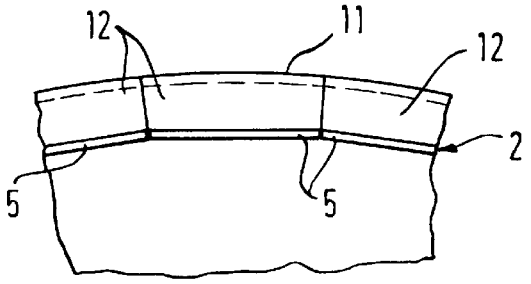
FIG. 4 A plan view of the polygon blade ring in the vicinity of the outer ring along arrow IV in FIG. 3.

FIG. 4 shows the polygonal outer ring 2 in a detail and in a plan view of the elements 12. This plan view is intended to make it clear that with an appropriate number of polygon segments 5, there is a minimum divergence from the associated arc, as is apparent from the representation of the parallel mill casing 11.

Figure 5:
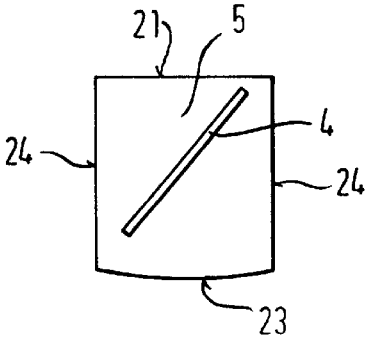
FIG. 5 A plan view of an outer polygon segment with guide blade along arrow V in FIG. 3.

FIG. 5 shows an outer polygon segment 5 with a guide blade 4 fixed thereto. The number and positioning, as well as the size of the guide blades 4 relative to the polygon segments 5 are only shown in exemplified manner and can be varied. The plan view of the outer polygon segment 5 shows that the latter, like the associated inner polygon segment 6 of a not shown, polygonal inner ring, due to the straight edges, can be manufactured particularly easily and can in particular be cut to size from superimposed, stacked metal sheets. An upper, horizontal edge 21 and the vertical, lateral edges 24 are straight and a lower edge 23 is curved and engages in the installed state on the mill casing 11 (FIG. 3). It is possible to integrate the element 12 into the polygon segment 5.

What is claimed is:

1. Blade ring for air-swept roller mills comprising:

an outer ring;

an inner ring; and guide blades positioned between said outer ring and said inner ring and forming flow ducts;

wherein said blade ring is constructed as a polygonal blade ring and at least said outer ring is polygonally constructed and comprises a plurality of planar metal sheets as outer polygon segments.

2. Blade ring according to claim 1, wherein said outer ring is a segmented polygonal ring.

3. Blade ring according to claim 2, wherein said inner ring is an outer surface of a grinding bowl.

4. Blade ring according to claim 3, wherein said guide blades are fixed to said outer polygon segments and have an inner edge which is arranged parallel to and with a limited spacing from said outer surface of the grinding bowl.

5. Blade ring according to claim 2, wherein said guide blades are arranged in inclined manner with a predetermined setting angle $\alpha$ and in or counter to a grinding bowl rotation direction.

6. Blade ring according to claim 2, wherein in each case at least one guide blade is placed on said outer polygon segments.

7. Blade ring according to claim 6, wherein said outer polygon segments are arranged in vertical manner and are connected to said polygonal outer ring.

8. Blade ring according to claim 7, wherein said outer polygon segments are arranged in inclined manner and are connected to said polygonal outer ring.

9. Blade ring according to claim 6, wherein several of said outer polygon segments are connected to a polygon run and several of said polygon runs are connected to said segmented polygonal ring.

10. Blade ring according to claim 9, wherein said polygon runs have the same number of polygon segments.

11. Blade ring according to claim 9, wherein said polygon runs have a different number of polygon segments.

12. Blade ring according to claim 9, wherein said polygon segments are connected detachably to the polygon runs and said polygon runs are detachably interconnected to said polygonal ring.

13. Blade ring according to claim 9, wherein said inner ring has a polygonal construction of inner polygon segments which are positioned facing said outer polygon segments.

14. Blade ring according to claim 13, wherein said inner polygon segments and said outer polygon segments are in each case interconnected by at least one of said guide blades to a polygon segment and several of said polygon segments are connected to said polygon run.

15. Blade ring according to claim 14, wherein said guide blades are welded to said polygon segments.

16. Blade ring according to claim 6, wherein said guide blades are fixed centrally to said outer polygon segments.

17. Blade ring according to claim 6, wherein said guide blades are fixed eccentrically to said outer polygon segments.

18. Blade ring according to claim 1, wherein said guide blades are detachably fixed.

19. Blade ring according to claim 1, wherein said guide blades are planar or curved.

* * * * *